United States Patent [19]

Saari et al.

[11] 4,075,089

[45] Feb. 21, 1978

[54] FLOTATION CELL WITH ECCENTRIC ROTOR AND STATOR

[75] Inventors: Kaarlo Matti Juhani Saari, Vanha-Ulvila; Aarno Iisakki Kalliokoski, Ulvila, both of Finland

[73] Assignee: Outokumpu Oy, Helsinki, Finland

[21] Appl. No.: 757,951

[22] Filed: Jan. 10, 1977

[30] Foreign Application Priority Data

Jan. 13, 1976 Finland ..... 760066

[51] Int. Cl.[2] ..... B03D 1/24

[52] U.S. Cl. ..... 209/169; 210/221 M; 261/87; 261/93; 415/90; 366/264

[58] Field of Search ..... 209/168, 169; 210/44, 210/219, 221 M; 261/93, 87, 84; 259/38, 95, 96; 415/90

[56] References Cited

U.S. PATENT DOCUMENTS

| | | | |
|---|---|---|---|
| Re. 27,380 | 5/1972 | Anderson | 261/87 |
| 1,661,940 | 3/1928 | Green | 415/90 |
| 2,055,065 | 9/1936 | Booth | 261/93 |
| 2,190,852 | 2/1940 | Tucker | 261/93 |
| 2,557,174 | 6/1951 | Cowles | 259/96 |
| 2,612,358 | 9/1952 | Daman | 261/93 |
| 2,673,724 | 3/1954 | Potts | 261/87 |
| 2,875,897 | 3/1959 | Booth | 209/169 |
| 2,966,266 | 12/1960 | Coke | 261/93 |
| 3,017,848 | 1/1962 | Bishop | 415/90 |
| 3,268,212 | 8/1966 | Ziselberger | 259/96 |
| 3,395,513 | 8/1968 | Van Unwerth | 26/93 |
| 3,491,880 | 1/1970 | Reck | 209/169 |
| 3,827,836 | 8/1974 | Scheibe | 415/90 |
| 3,872,010 | 3/1975 | Nagahama | 210/219 |
| 3,882,016 | 5/1975 | Green | 210/221 M |

*Primary Examiner*—Thomas G. Wyse
*Assistant Examiner*—Ernest G. Therkorn

[57] ABSTRACT

A flotation cell of the type comprising at least one froth removal edge and a rotor and stator adapted to be immersed in the liquid to be flotated, in order to direct the surface flow in the flotation cell towards its removal edge or edges, the clearance between the rotor and the stator, as seen in the rotation direction of the rotor, widens in that rotational sector or those rotational sectors of the rotor which is or which are substantially towards the removal edge or edges and respectively converges in the other rotation sector or the intermediate rotational sectors of the rotor.

2 Claims, 10 Drawing Figures

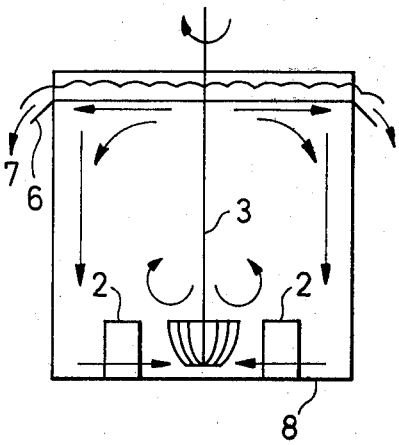
FIG. 3b
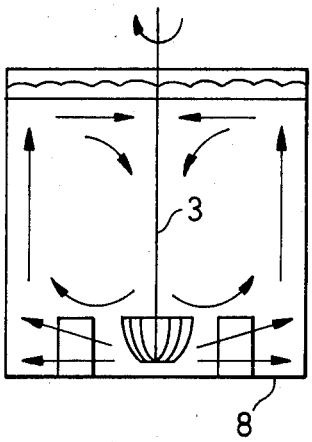
FIG. 3a
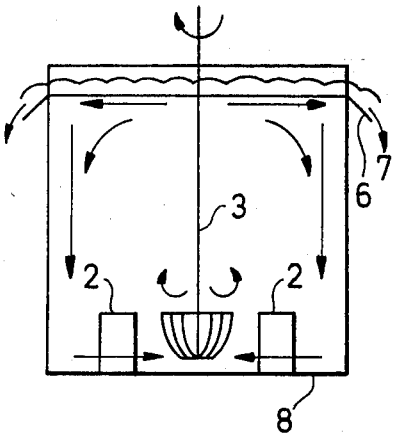
FIG. 3c
FIG. 3
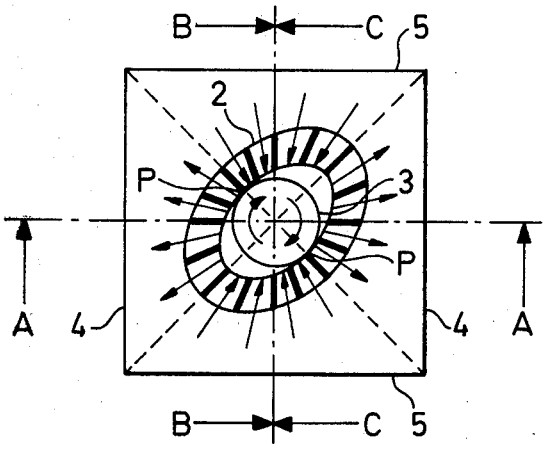
FIG. 4
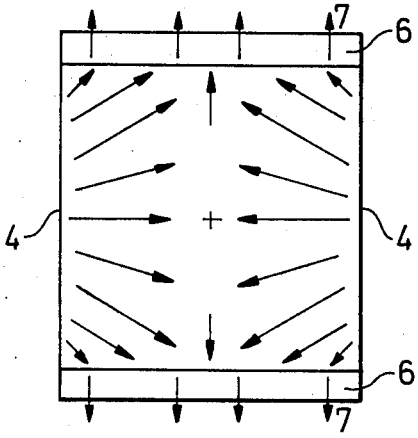

FLOTATION CELL WITH ECCENTRIC ROTOR AND STATOR

BACKGROUND OF THE INVENTION

The present invention relates to a flotation cell with one or more edges for removing froth and with a rotor and stator meant to be immersed in the liquid to be flotated.

Froth flotation is commonly used, for example, in mineral concentration technology for the separation of valuable minerals from reject matte and in the regeneration of waste paper for the separation of inks from waste-paper pulp. The flotation technique is based on the selective property of finely ground mineral or other surfaces, in a liquid, to adhere to the surface of a gas bubble, usually air, while the other particles do not; this property can be natural or produced artificially by chemical means.

Flotation is usually performed by means of an apparatus called a flotation cell. Its purpose is to produce gas-liquid interfaces, to contact the particles with them, i.e., bubbles, and to separate accept and reject particles from each other. The particles adhering to the gas bubbles form a froth on the slurry surface in the cell. In conventional cells the removal of the froth from the cell is performed by means of separate froth skimmers, or the froth layer may be so thick that the froth flows, under the effect of gravity, over the froth removal edge.

In the most commonly used flotation cells, air is dispersed into the slurry, and the slurry is mixed by means of a rotor revolving about a vertical shaft. The air is fed through the shaft and rotor or through separate nozzles. The rotor is concentric with the stator surrounding it. In this case, the flow pattern in a mixing vessel (flotation cell) concentric with the stator-rotor system is labile; mixing flows rise to the surface at different spots and the surface flow has no definite direction. In some cell types attempts have been made to quide the flows by means of baffles.

The object of the present invention is to provide a flotation cell of the above type, but with a possibility of controlling and regulating the surface flow in the desired direction within the cell by means of the pumping effect of the rotorstator system.

SUMMARY OF THE INVENTION

According to the invention the pumping effect can be produced in several different manners so that the slurry flow or the froth flow is directed toward the froth removal edge or edges, in which case the surface flow pushes the froth over the edge. In a flotation cell according to the invention, no froth skimmers of baffles are necessary and the turbulence of the slurry or froth surface is much less than in conventional cells.

In a flotation cell according to the invention, the pumping effect is utilized by making the rotor and the stator substantially eccentric with each other. The desired, directed surface flow effect is promoted when the eccentricity increases. The stator of the cell which discharges froth from two sides is oval so that rising flow occurs at the ends of the cell and that the froth can leave at edges or both sides. Baffles are not needed.

By means of this developed directed pumping effect, a surface flow with the desired direction is obtained. In accordance with known mixing and pumping formulas, a sufficient mixing and air dispersing efficiency can be maintained when the surface turbulence is small. Rising flow to the surface mainly appears only at the back wall or, in a cell discharging at both sides, mainly at the ends.

DESCRIPTION OF THE DRAWINGS

FIG. 3 depicts a plan cross section of an alternative embodiment of the invention, FIGS. 3*a–c* depict sections A—A, B—B, and C—C in FIG. 3, and FIG. 4 depicts a top view of the flotation cell in FIG. 3.

DESCRIPTION OF THE PREFERRED EMBODIMENTS

Figures 1A, 1B, 1C:
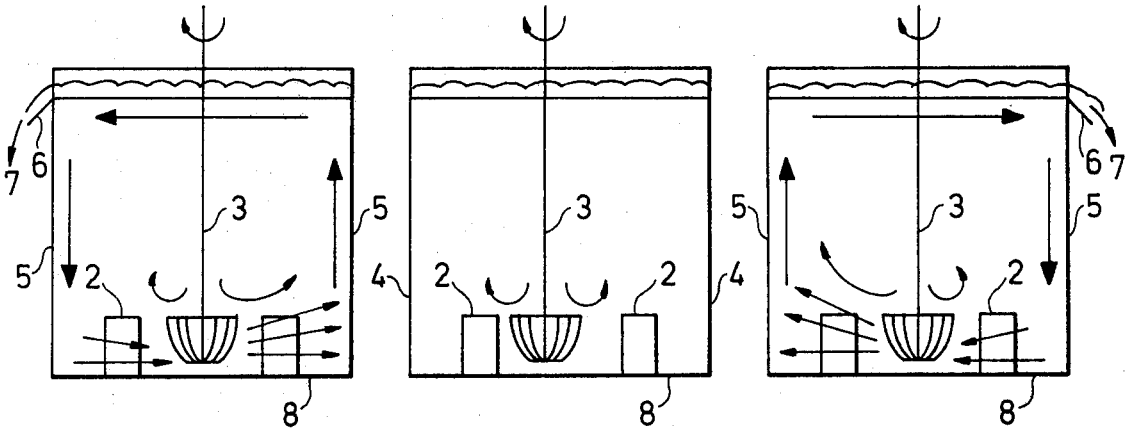
FIGS. 1*a–c* depict sections A—A, B—B and C—C in FIG. 1.

Although not shown in the figures, it is evident that the flotation cells shown in the figures also contain devices for feeding the slurry to be flotated into the cell 1 and an outlet pipe for removing the underflow from the cell. The flow and rotation directions are indicated by arrows.

In the embodiments shown in FIGS. 1–4 the corresponding parts are indicated by the same reference numerals. Thus numeral 1 indicates a flotation cell having end walls 4, front and back walls 5, and bottom 8, which together delimit a space which opens upwards. The liquid to be flotated is fed into the space and the underflow is removed in such a manner that the surface of the liquid removal edge 6 so that froth 7 is pushed over it under the effect of the surface flow of the slurry.

Furthermore, in the flotation cell 1 there is fitted a rotor 3 rotating about a vertical shaft. A stator 2, which can be circular (FIG. 1), or oval or elliptical (FIG. 3) has been fitted around the rotor 3 at the bottom 8 of the flotation cell 1.

Figure 1:
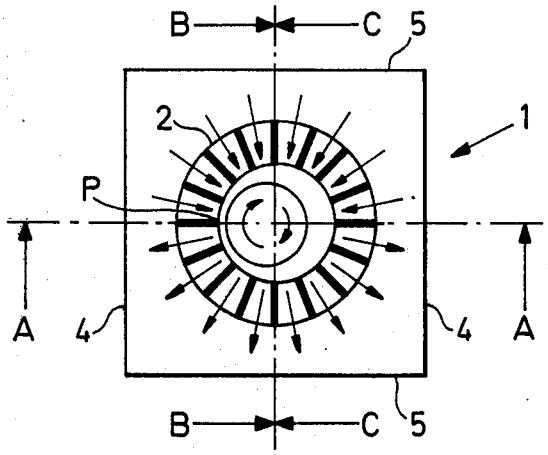
FIG. 1 shows a plan cross section of a preferred embodiment of the invention.
Figure 2:
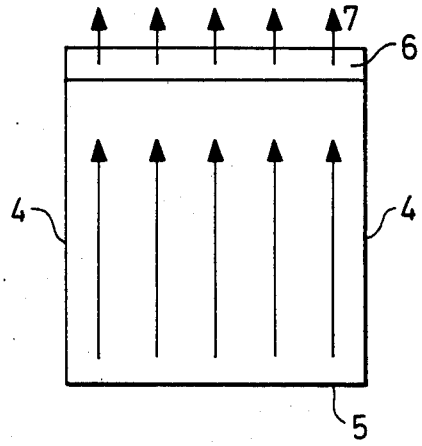
FIG. 2 depicts a top view of the flotation cell in FIG. 1.

The rotor 3, eccentric with the stator 2, operates according to the principle of a centrifugal pump, and the pumping effect can be utilized as follows:

Point P on the circumference of the rotor 3 is observed when the rotor 3 rotates inside the stator 2 (FIG. 1). When point P starts from the position where the distance between the stator 2 and the rotor 3 is at a minimum, point P moves farther away from the stator 2, the clearance increasing when the rotor 3 rotates. Thus a suction effect is created, and the flow of slurry and air is promoted into the clearance between the rotor 3 and the stator 2. The maximum clearance is on the opposite side, 180° from the initial position. Thereafter, when the rotor 3 rotates further, the clearance begins to diminish and point P approaches the inner circumference of the stator 2. Thereby the suspension-dispersion begins to be compressed and flow out between the plates of the stator 2, as in a centrifugal pump, and is directed into an area 180°–360° from the initial position, until after 360° the initial position is reached, at which the clearance is at a minimum and point P on the rotor 3 circumference is closest to the inner circumference of the stator 2. This is repeated when the rotor 3 rotates. The suspension-dispersion flow discharging from the stator 2, when proceeding, finally impinges against the wall 5 of the flotation cell and rises to the surface. Since the flow is continuous, the flow which has reached the surface is directed along the surface to the opposite side, carrying the froth, and the froth 7 is pushed over the froth removal edge 6, while the slurry (suspension) flows downwards to the principal suction flow of the rotor 3. If the rotational direction of the rotor 3 is reverse to that described above, the surface flow is also in the reverse direction and the removal of the froth must take place on the side opposite to that indicated above. Also, when the rotational direction of the rotor is reversed, the smallest clearance can be on the side opposite (180°) to the initial position, whereby the surface flow is still directed in the initial direction towards the froth removal edge 6.

In a cell 1 discharging on two sides (FIG. 3), the stator 2 must be oval or elliptical. Thereby the pumping effect and eccentricity are repeated twice during one revolution of the rotor 3. The flow from the stator 2 is directed towards the ends 4 of the cell 1 and directed from there upwards and then laterally. The surface flows then impinge against each other and turn towards the froth removal edges 6. At the froth removal edges 6 the froth 7 is pushed over the edge and the slurry passes downwards to the suction sides of the rotor-stator combination.

By comparing the results (Tables 1 and 2) from flotation experiments performed by using apparatus according to the invention to those obtained by using conventional flotation cells, it can be observed that a higher Ni content in the concentrate and a greated degree of whiteness of waste paper are achieved by means of apparatus according to the invention, i.e., its selectivity is better than that of a conventional cell. In addition, in apparatus according to the present invention the froth discharges from the cell automatically, but from a conventional cell the froth must be removed by means of a froth skimmer.

In principle the idea of the invention can be applied in all the most common flotation apparatuses having a rotor-stator combination. In a cell discharging on both sides the stator can be split and extensions added in between, whereby an oval stator is obtained.

Table 1.

| Flotation comparison experiment performed with nickel ore from Hitura | % Ni | | |
|---|---|---|---|
| | Feed | Concentrate | Yield |
| Eccentric rotor | 0.356 | 4.2 | 59.5 |
| Concentric rotor | 0.356 | 4.0 | 59.5 |

The experimental conditions were identical in both apparatuses.

Table 2.

| Comparison experiment of ink flotation of waste paper | Whiteness, Scan-% | |
|---|---|---|
| | Feed | Product, i.e., purified pulp |
| Eccentric rotor | 48.5 | 57.1 |
| Concentric rotor | 48.5 | 55.4 |

The experimental conditions were identical in both apparatuses.

We claim:

1. A flotation cell for separating by flotation a material from a mixture of the material in a liquid vehicle, comprising a vessel for the mixture provided with at least one upper edge for discharge of substantial amounts of the material thereover, a fixed annular stator provided in the bottom of said vessel and having radial passages therethrough, the axis of said stator being substantially parallel with the vertical axis of said vessel, a rotor disposed within said annular stator for impelling the mixture, the axis of said rotor being substantially parallel with the axis of said stator and spaced therefrom so that one side of said rotor is spaced from the inner surface of said annular stator a greater distance than the opposed side of said rotor and means for rotating said rotor whereby the mixture of the material in the liquid vehicle flows inwardly through the radial passages on that side of said stator where the distance between said rotor and said stator increases in the direction of rotation of said rotor and flows outwardly through the radial passages on the opposed side of said stator thus providing a flow of the mixture across the top of said vessel in substantially one direction toward the discharge edge of said vessel.

2. A flotation cell for separating by flotation a material from a mixture of the material in a liquid vehicle, comprising a vessel for the mixture provided with two opposed upper edges for discharge of substantial amounts of the material thereover, an ellipsoidal stator ring fixed in the bottom of said vessel and having radial passages therethrough, the axis of said stator ring being substantially parallel with the vertical axis of said vessel, a rotor disposed within said stator ring, the axis of said rotor coinciding with the axis of said stator ring so that opposed sides of said rotor are spaced from the inner surface of said ellipsoidal stator ring a greater distance than those opposed sides intermediate the first mentioned opposed sides, and means for rotating said rotor whereby the mixture of the material in the liquid vehicle flows inwardly through those passages on opposed sides of said stator ring where the distance between said rotor and said stator ring increases in the direction of rotation of said rotor and flows outwardly through those opposed radial passages where the distance between said rotor and said stator ring decreases in the direction of rotation of said rotor thus providing flow of the mixture at the top of said vessel in substantially opposed directions toward the two opposed discharge edges of said vessel.

* * * * *